US011330689B2

(12) United States Patent
Tseng et al.

(10) Patent No.: US 11,330,689 B2
(45) Date of Patent: May 10, 2022

(54) DISPLAY DEVICE

(71) Applicant: Innolux Corporation, Miao-Li County (TW)

(72) Inventors: Ming Chun Tseng, Miao-Li County (TW); Chin-Lung Ting, Miao-Li County (TW); Ker-Yih Kao, Miao-Li County (TW); Kung-Chen Kuo, Miao-Li County (TW); Lien-Hsiang Chen, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/037,589

(22) Filed: Sep. 29, 2020

(65) Prior Publication Data

US 2021/0136895 A1 May 6, 2021

Related U.S. Application Data

(60) Provisional application No. 62/927,758, filed on Oct. 30, 2019.

(30) Foreign Application Priority Data

Aug. 12, 2020 (CN) ..... 202010806283.4

(51) Int. Cl.
*H05B 45/40* (2020.01)
*H05B 45/48* (2020.01)

(52) U.S. Cl.
CPC ..... *H05B 45/48* (2020.01)

(58) Field of Classification Search
CPC ..... H05B 45/10; H05B 45/40; H05B 45/48; H05B 45/54; H05B 47/10; H05B 47/23
See application file for complete search history.

(56) References Cited

U.S. PATENT DOCUMENTS 8,723,446 B2 * 5/2014 Hoogzaad ..... H05B 45/3725 315/307
2004/0008165 A1 1/2004 Yen-Hua
2007/0159750 A1 7/2007 Peker et al.
2007/0257623 A1 * 11/2007 Johnson ..... H05B 45/24 315/193

(Continued)

FOREIGN PATENT DOCUMENTS

WO 2009034014 3/2009

OTHER PUBLICATIONS

"Office Action of China Counterpart Application", dated Sep. 6, 2021, p. 1-p. 8.

*Primary Examiner* — Jimmy T Vu
(74) *Attorney, Agent, or Firm* — JCIPRNET

(57) ABSTRACT

A display device is provided. The display device includes a plurality of light-emitting modules. The at least one of the plurality of light-emitting modules includes a light-emitting unit group. The light-emitting unit group includes a plurality of light-emitting units coupled to each other in series. The first current source is coupled to the light-emitting unit group, and configured to provide a first current to drive the plurality of light-emitting units. The bypass unit includes a plurality of first switch units. The bypass unit is coupled to the light-emitting unit group in parallel. The plurality of first switch units are coupled to the plurality of light-emitting units in parallel.

10 Claims, 6 Drawing Sheets

(56) References Cited

U.S. PATENT DOCUMENTS

| | | | | |
|---|---|---|---|---|
| 2016/0165678 | A1* | 6/2016 | Sudhaus | H05B 45/24 315/161 |
| 2017/0086266 | A1* | 3/2017 | Buthker | H05B 47/16 |

* cited by examiner

DISPLAY DEVICE

CROSS-REFERENCE TO RELATED APPLICATION

This application claims the priority benefits of U.S. provisional application Ser. No. 62/927,758, filed on Oct. 30, 2019, and China application serial no. 202010806283.4, filed on Aug. 12, 2020. The entirety of each of the above-mentioned patent applications is hereby incorporated by reference herein and made a part of this specification.

BACKGROUND

Technical Field

The disclosure relates to a display device, and in particular, relates to a display device having a bypass unit.

Description of Related Art

In a display device formed by light-emitting units, generally, a plurality of light-emitting units are connected in series to form a light-emitting unit group. When one of the light-emitting units in the light-emitting unit group is open, the light-emitting unit group may not normally provide the light-emitting function. Accordingly, several solutions are provided in the embodiments as follows to set the light-emitting unit group to continue to provide an effective light-emitting function.

SUMMARY

The disclosure provides a display device including a plurality of light-emitting modules according to the embodiments of the disclosure. At least one of the plurality of light-emitting modules includes a light-emitting unit group, a first current source, and a bypass unit. The light-emitting unit group include a plurality of light-emitting units coupled to each other in series. The first current source is coupled to the light-emitting unit group, and configured to provide a first current to drive the plurality of light-emitting units. The bypass unit includes a plurality of first switch units. The bypass unit is coupled to the light-emitting unit group in parallel. The plurality of first switch units are coupled to the plurality of light-emitting units in parallel.

The accompanying drawings are included together with the detailed description provided below to provide a further understanding of the disclosure. Note that in order to make the accompanying drawings to be more comprehensible to readers and for the sake of clarity of the accompanying drawings, only part of the display device is depicted in the accompanying drawings of the disclosure, and specific components in the drawings are not depicted according to actual scales. In addition, the number and size of each component in each drawing are provided for illustration only and are not used to limit the scope of the disclosure.

DESCRIPTION OF THE EMBODIMENTS

Throughout the specification and appended claims of the disclosure, certain terms are used to refer to specific components. A person of ordinary skill in the art should understand that display apparatus manufacturers may refer to the same components by different names. In the specification, it is not intended to distinguish between components that have the same function but different names. In the following specification and claims, the words "containing" and "including" are open-ended words and therefore should be interpreted as "containing but not limited to . . . ".

In some embodiments of the disclosure, regarding the words such as "coupled", "interconnected", etc. referring to bonding and connection, unless specifically defined, these words mean that two structures are in direct contact or two structures are not in direct contact, and other structures are provided to be disposed between the two structures. The word for joining and connecting may also include the case where both structures are movable or both structures are fixed. In addition, the word "coupled" may include to any direct or indirect electrical connection means.

The ordinal numbers used in the specification and claims, such as "first", "second", etc., are used to modify the components, and they do not imply or represent the, or these, components have any previous ordinal numbers, do not represent the order of a component and another component, or the order of a manufacturing method. The use of these ordinal numbers is only used to clearly distinguish a component with a certain name from another component with the same name. The terms used in the claims and the specification may not have to be the same, and accordingly, the first component provided in the specification may be the second component in the claims. It should be understood that in the following embodiments, the technical features of several different embodiments may be replaced, recombined, and mixed to complete other embodiments without departing from the spirit of the disclosure.

Figure 1:
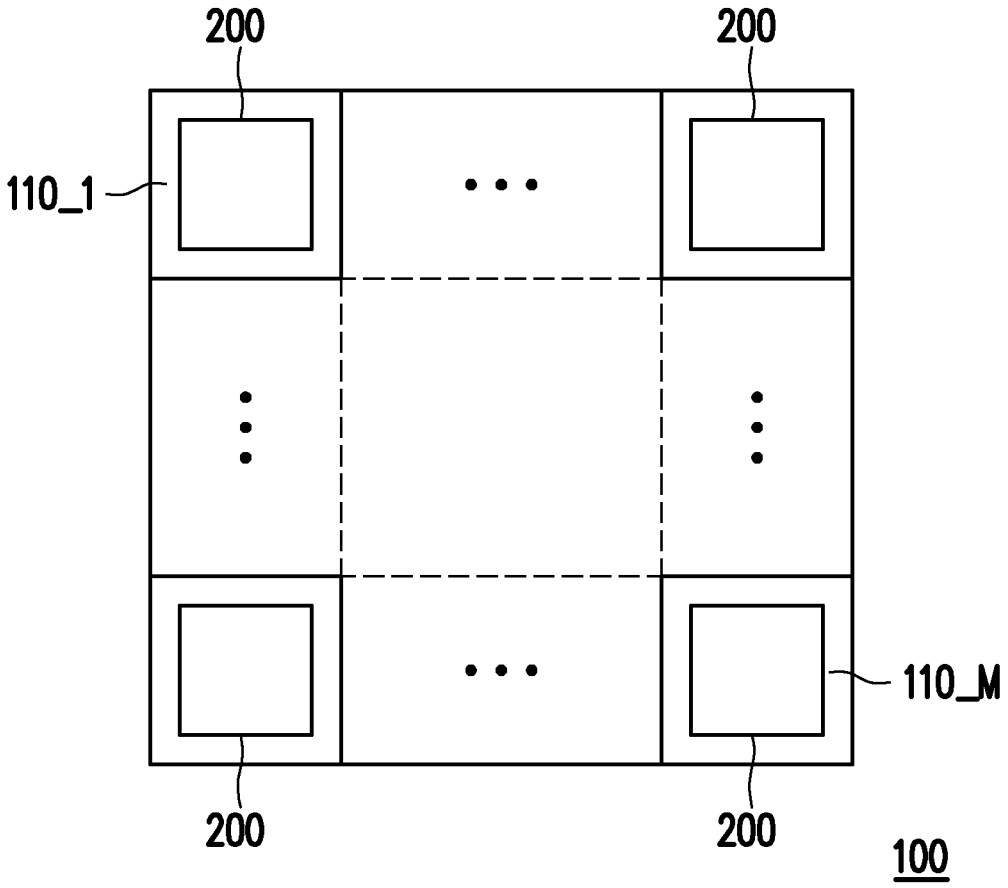
FIG. 1 is a schematic diagram of a display device according to an embodiment of the disclosure.

FIG. 1 is a schematic diagram of a display device according to an embodiment of the disclosure. With reference to FIG. 1, a display device 100 includes a plurality of light-emitting regions 110_1 to 110_M, where M is a positive integer. According to some embodiments, the light-emitting regions 110_1 to 110_M may be arranged into an array, but are not limited thereto. In this embodiment, the display device 100 may include a plurality of light-emitting modules 200, and the light-emitting modules 200 may be disposed in the light-emitting regions 110_1 to 110_M respectively. In this embodiment, the display device 100 may be, for example, a liquid crystal display device, an organic light emitting diode (OLED) display device, an inorganic light emitting diode (ILED) display device, a mini-LED display device, a micro-LED display device, a quantum dot (QD) display device, a QLED/QDLED display device, or an electro-phoretic display device and the like, but the disclosure is not limited thereto.

In some embodiments of the disclosure, the display device 100 may be a liquid crystal display device. The display device 100 may include a liquid crystal panel (not shown) and a backlight module. The plurality of light-emitting modules 200 may act as the backlight module of a liquid crystal display device, and the light-emitting modules 200 may provide a light source to one or a plurality of pixel units of the liquid crystal panel. The light-emitting regions 110_1 to 110_M may correspond to one or a plurality of pixel units of the liquid crystal panel. In addition, according to some embodiments, the display device 100 may be a mini-LED display device and may include a display panel. The light-emitting modules 200 may act as a plurality of pixel units in the display panel.

Figure 2:
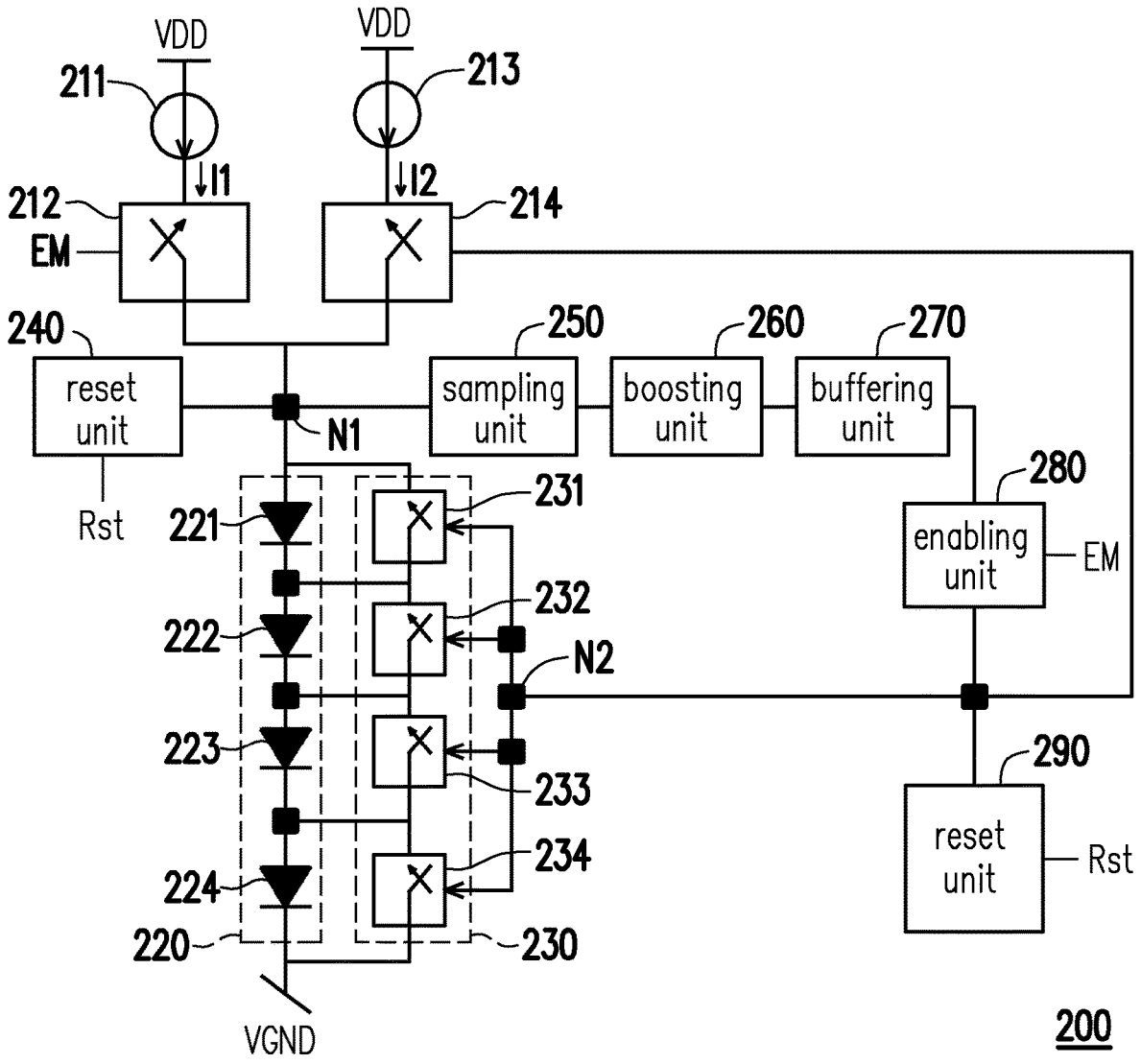
FIG. 2 is a block diagram of functions of a light-emitting module according to an embodiment of the disclosure.

FIG. 2 is a block diagram of functions of a light-emitting module according to an embodiment of the disclosure. With reference to FIG. 2, at least one of the light-emitting modules 200 shown in FIG. 1 may include current sources 211 and 213, switch units 212 and 214, a light-emitting unit group 220, a bypass unit 230, reset units 240 and 290, a sampling unit 250, a boosting unit 260, a buffering unit 270, and an enabling unit 280. In some embodiments of the disclosure, although not shown in the figure, each of the light-emitting modules 200 shown in FIG. 1 may include the components shown in FIG. 2. In this embodiment, the current source 211 is coupled between a voltage VDD and the switch unit 212 and is configured to provide a first current I1 to the switch unit 212. The switch unit 212 receives an enabling signal EM and determines whether to be turned on according to the enabling signal EM to provide the first current I1 to a node N1. The current source 213 is coupled between the voltage VDD and the switch unit 214 and is configured to provide a second current I2 to the switch unit 214. According to some embodiment, the second current I2 may be less than the first current I1. The light-emitting unit group 220 is coupled between the node N1 and a ground voltage VGND. The light-emitting unit group 220 includes a plurality of light-emitting units 221 to 224 coupled to each other in series. The bypass unit 230 is coupled to the light-emitting unit group 220 in parallel. The bypass unit 230 includes a plurality of switch units 231 to 234. The switch units 231 and 234 are coupled to the light-emitting units 221 to 224 in parallel one to one, so as to respectively provide corresponding current bypass paths to the light-emitting units 221 to 224.

In some embodiments of the disclosure, the switch units provided by the disclosure may be transistors, and the transistors may be, for example, N-type transistors, P-type transistors, or a combination thereof, but are not limited thereto. In this embodiment, each of the light-emitting units 221 to 224 may be, for example, a light-emitting diode (LED), an OLED, an ILED, a mini-LED, a micro-LED, a QD, a QLED/QDLED, or an electro-phoretic light-emitting unit and the like. A unit type of the light-emitting units 221 to 224 may be determined according to a type of the display device, which is not particularly limited by the disclosure.

In some embodiments of the disclosure, when at least one of the light-emitting unit in the light-emitting unit group 220 is damaged or fails, a serial path of the light-emitting units 221 to 224 is open. In this case, the sampling unit 250, the boosting unit 260, the buffering unit 270, and the enabling unit 280 of the light-emitting module 200 may determine whether at least one of the light-emitting units 221 to 224 is damaged or fails according to a voltage change of the node N1. When at least one of the light-emitting units 221 to 224 is open, the enabling unit 280 may be configured to turn on the switch units 231 to 234 to form a bypass to the open light-emitting unit. Further, when at least one of the light-emitting units 221 to 224 is open, the enabling unit 280 may also be configured to turn on the switch unit 214, so that the light-emitting unit group 220 may receive the first current I1 and the second current I2 together through the node N1. In this way, when at least one light-emitting unit in the light-emitting unit group 220 is damaged or fails, causing the serial path of the light-emitting units 221 to 224 to be open, in the disclosure, a bypass may be formed owing to arrangement of the bypass unit 230 to set the normal light-emitting units among the light-emitting units 221 to 224 to be electrically connected, such that the light-emitting unit group 220 may continue to emit light. If the light-emitting unit can emit light or be lit, the light-emitting unit is called the normal light-emitting unit. In other word, except for non-luminous or damaged light-emitting units, other light-emitting units can be regarded as the normal light-emitting units. From another perspective, we can analyze a display product to prove whether the display product implements the display device provided by the present disclosure or not. In the display product to be analyzed, if the light-emitting regions include additional current source, when at least one light-emitting unit in the light-emitting unit group fails, and the additional current source may be configured to provide additional driving current, it may be regarded that the display product implements the display device provided by the disclosure is implemented by such display product.

In this embodiment, the sampling unit 250 is coupled to the light-emitting unit group 220 through the node N1 and is configured to sample a voltage of the node N1. The boosting unit 260 is coupled to the sampling unit 250. The buffering unit 270 is coupled to the boosting unit 260 and the enabling unit 280. The enabling unit 280 is coupled to the bypass unit 230 and the switch unit 214 through a node N2. The enabling unit 280 receives the enabling signal EM to determine whether to turn on the switch units 231 to 234 of the bypass unit 230 and the switch unit 214 according to the enabling signal EM, and the switch units 231 to 234 of the bypass unit 230 and the switch unit 214 are turned on according to a voltage sampling result of the sampling unit 250 sampling the node N1. To be specific, the boosting unit 260 may boost a first voltage provided by the sampling unit 250 sampling the node N1 to be converted into a second voltage, and the buffering unit 270 may provide a third voltage to the enabling unit 280 according to the second voltage. Therefore, the enabling unit 280 may determine whether to provide the third voltage to the switch units 231 to 234 of the bypass unit 230 and the switch unit 214 according to the enabling signal EM, so that the switch units 231 to 234 and the switch unit 214 may determine whether to be turned on according to the third voltage. Further, in some embodiments of the disclosure, the switch units 231 to 234 and the switch unit 214 may be simultaneously turned on.

In other words, the switch unit 212 and the enabling unit 280 may be simultaneously turned on according to the enabling signal EM. Next, when part of the light-emitting units 221 to 224 is damaged or fails and is open, the voltage of the node N1 is to be changed. Therefore, the sampling unit 250 may provide the voltage sampling result of the node N1 to the boosting unit 260, the buffering unit 270, and the enabling unit 280 and provides the corresponding third voltage through the enabling unit 280 to the node N2 to turn on the switch units 231 to 234 and the switch unit 214. Therefore, the switch units 231 to 234 of the bypass unit 230 may provide the current bypass paths to at least one open light-emitting unit, and other normal light-emitting units that emit light may continue to emit light normally. Further, the switch unit 214 is turned on as well. As such, the current source 213 may provide the second current I2 to the node N1, so that the rest of the normal light-emitting units among the light-emitting units 221 to 224 may be driven by the first current I1 provided by the current source 211 and the second current I2 provided by the current source 213.

In this embodiment, the reset unit 240 is coupled to the node N1. Before the sampling unit 250 samples the voltage of the node N1, the reset unit 240 may reset the voltage of the node N1 according to a reset signal Rst, so that the sampling unit 250 may correctly sample the voltage of the node N1. The reset unit 290 is coupled to the node N2. Before the sampling unit 250 samples the voltage of the node N1, the reset unit 290 may reset a voltage of the node N2 according to the reset signal Rst as well, so that the switch units 231 to 234 of the bypass unit 230 may be operated in a closed state in advance according to the reset voltage of the node N2.

Figure 3:
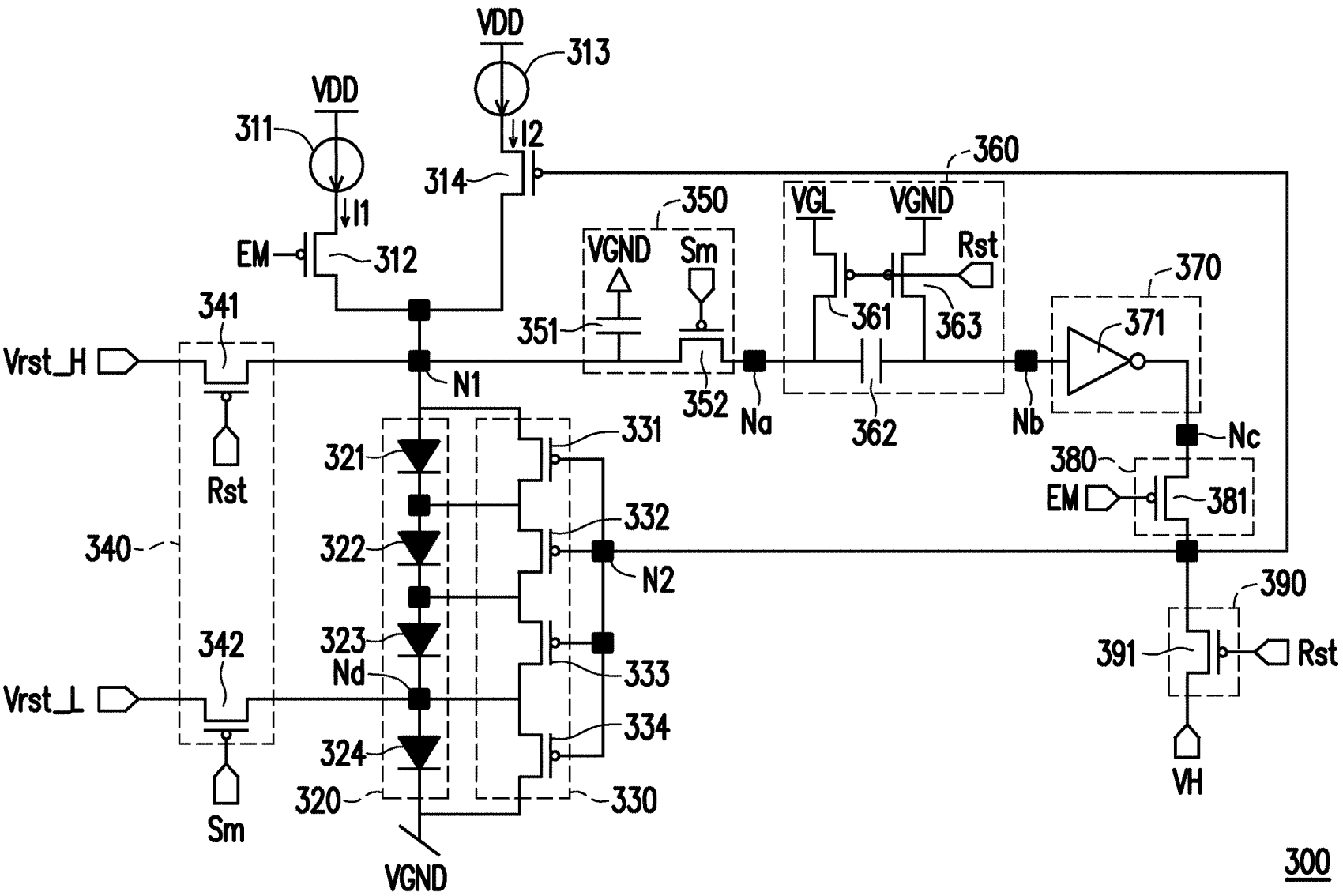
FIG. 3 is a schematic diagram of circuits of a light-emitting module according to an embodiment of the disclosure.

FIG. 3 is a schematic diagram of circuits of a light-emitting module according to an embodiment of the disclosure. With reference to FIG. 3, in this embodiment, a switch unit is implemented as a P-type transistor to act as an example of a circuit implementation manner. In this embodiment, a light-emitting module 300 includes current sources 311 and 313, switch units 312 and 314, a light-emitting unit group 320, a bypass unit 330, reset units 340 and 390, a sampling unit 350, a boosting unit 360, a buffering unit 370, and an enabling unit 380. In this embodiment, the switch units 312 and 314 may be P-type transistors. In this embodiment, the current source 311 is coupled between the voltage VDD and a first terminal of the switch unit 312 and is configured to provide the first current I1 to the first terminal of the switch unit 312. A second terminal of the switch unit 312 is coupled to the node N1. A control terminal of the switch unit 312 receives the enabling signal EM and determines whether to be turned on according to the enabling signal EM, so that the second terminal of the switch unit 312 provides the first current I1 to the node N1. In this embodiment, the current source 313 is coupled between the voltage VDD and a first terminal of the switch unit 314 and is configured to provide the second current I2 to the first terminal of the switch unit 314. The light-emitting unit group 320 is coupled between the node N1 and the ground voltage VGND. The light-emitting unit group 320 includes a plurality of light-emitting units 321 to 324 coupled to each other in series. The bypass unit 330 is coupled to the light-emitting unit group 320 in parallel. The bypass unit 330 includes a plurality of switch units 331 to 334, and the switch units 331 to 334 may be P-type transistors. The switch units 331 and 334 are coupled to the light-emitting units 321 to 324 in parallel one to one, so as to respectively provide corresponding current bypass paths to the light-emitting units 321 to 324.

In this embodiment, the sampling unit 350 is coupled to the light-emitting unit group 320 through the node N1 and is configured to sample the voltage of the node N1. The sampling unit 350 includes a capacitor 351 and a switch unit 352. One terminal of the capacitor 351 is coupled to the ground voltage VGND, and another terminal is coupled to the node N1 to store a sampled voltage sampled from the node N1. The switch unit 352 may be a P-type transistor. A first terminal of the switch unit 352 is coupled to the node N1, and a second terminal of the switch unit 352 is coupled to a node Na. A control terminal of the switch unit 352 is coupled to a sampling signal Sm to determine whether to provide the sampled voltage stored by the capacitor 351 to the node Na according to the sampling signal Sm.

In this embodiment, the boosting unit 360 is coupled to the sampling unit 350. The boosting unit 360 includes switch units 361 and 363 and a capacitor 362. The switch units 361 and 363 may be P-type transistors. A first terminal of the switch unit 361 is coupled to a voltage VGL, and a second terminal of the switch unit 361 is coupled to the node Na. A control terminal of the switch unit 361 is coupled to the reset signal Rst. One terminal of the capacitor 362 is coupled to the second terminal of the switch unit 361 and the node Na. A first terminal of the switch unit 363 is coupled to the ground voltage VGND, and a second terminal of the switch unit 363 is coupled to another terminal of the capacitor 362 and a node Nb. A control terminal of the switch unit 363 is coupled to the reset signal Rst. In this embodiment, the buffering unit 370 is coupled to the boosting unit 360 and the enabling unit 380. The buffering unit 370 includes a buffer 371. An input terminal of the buffer 371 is coupled to the node Nb, and an output terminal of the buffer 371 is coupled to the enabling unit 380 through a node Nc. In this embodiment, the enabling unit 380 is coupled to the bypass unit 330 through the node N2. The enabling unit 380 includes a switch unit 381. The switch unit 381 may be a P-type transistor. A first terminal of the switch unit 381 is coupled to the node Nc, and a second terminal of the switch unit 381 is coupled to a control terminal of each one of the switch units 331 to 334 and the switch unit 314 through the node N2. A control terminal of the switch unit 381 receives the enabling signal EM to determine whether to turn on the switch units 331 to 334 and the switch unit 314 according to a voltage sampling result of the sampling unit 350 sampling the node N1 according to the enabling signal EM.

In this embodiment, the reset unit 340 is coupled to the node N1. The reset unit 340 includes switch units 341 and 342. The switch units 341 and 342 may be P-type transistors. A first terminal of the switch unit 341 is coupled to a voltage Vrst_H (high voltage level), and a second terminal of the switch unit 341 is coupled to the node N1. A control terminal of the switch unit 341 receives the reset signal Rst. A first terminal of the switch unit 342 is coupled to a voltage Vrst_L (low voltage level), and a second terminal of the switch unit 342 is coupled to a node Nd between the light-emitting unit 323 and the light-emitting unit 324. A control terminal of the switch unit 342 receives the sampling signal Sm. In this embodiment, the reset unit 390 is coupled to the node N2. The reset unit 390 includes a switch unit 391. The switch unit 391 may be a P-type transistor. A first terminal of the switch unit 391 is coupled to the control terminal of the switch unit 314, the second terminal of the switch unit 381, and the node N2. A second terminal of the switch unit 391 is coupled to a voltage VH (high voltage level). A control terminal of the switch unit 391 is coupled to the reset signal Rst.

Figure 4:
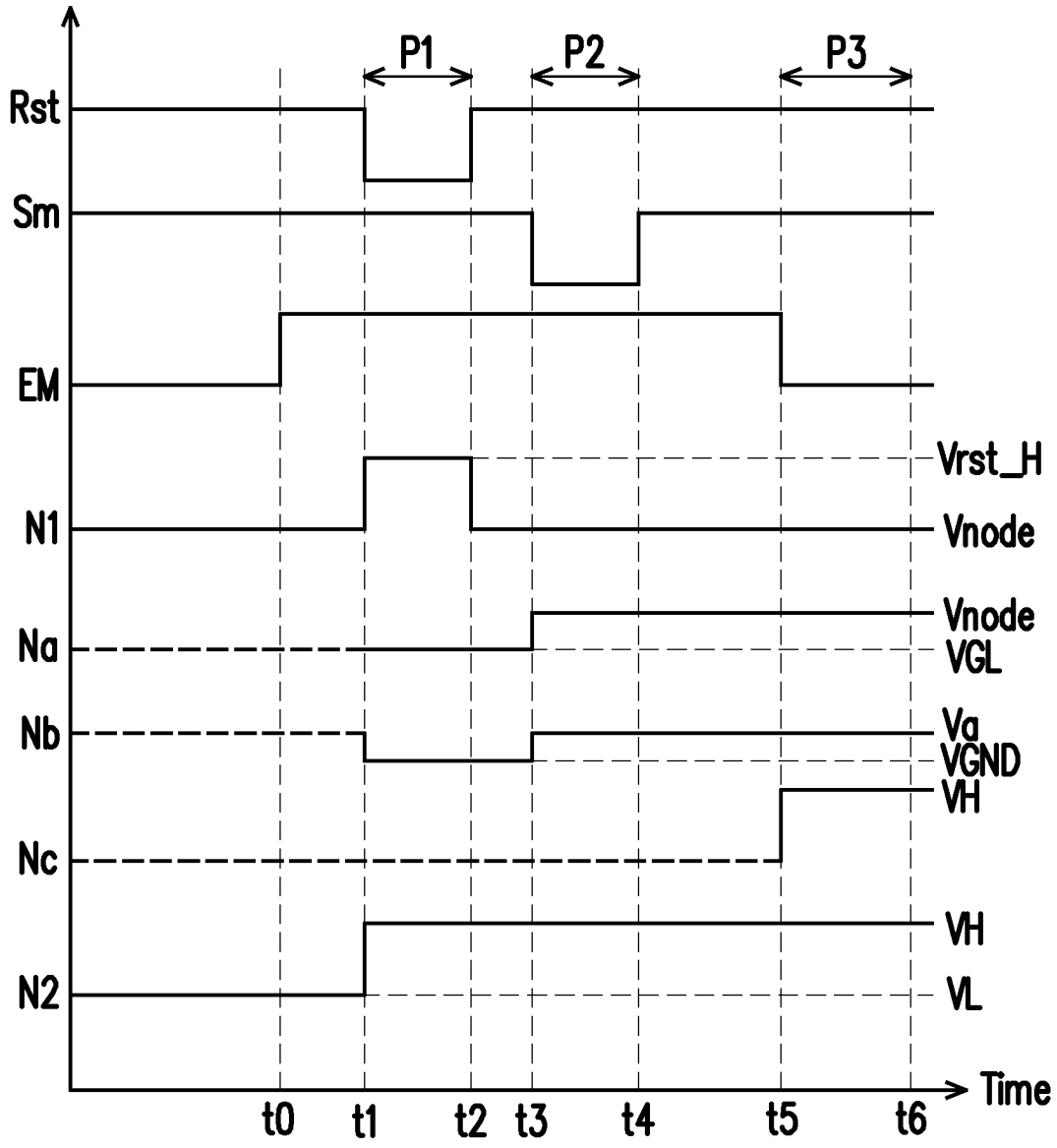
FIG. 4 is a sequence diagram of signal and voltage variations of the light-emitting module according to a first embodiment of the disclosure.

FIG. 4 is a sequence diagram of signal and voltage variations of the light-emitting module according to a first embodiment of the disclosure. With reference to FIG. 3 and FIG. 4, when all of the light-emitting units 321 to 324 of the light-emitting module 300 in FIG. 3 emit light normally (not damaged or fail), the signal and voltage variations of the light-emitting module 300 of FIG. 3 may be shown as the time sequence diagram provided by FIG. 4. In this embodiment, before time t0, the reset signal Rst and the sampling signal Sm are at high voltage levels, and the enabling signal Em is at a low voltage level. The switch unit 312 is turned on, and the current source 311 provides the first current I1 to the light-emitting units 321 to 324 through the node N1.

From time t0 to time t1, the reset signal Rst and the sampling signal Sm maintain high voltage levels, and the enabling signal Em is switched from a low voltage level to a high voltage level, so that the switch units 312, 341, 342, 352, 361, 363, 381, and 391 are turned off. During a reset period P1 from time t1 to time t2, the reset signal Rst is switched from a high voltage level to a low voltage level, so that the switch units 341, 361, 363, and 391 are switched to be turned on. In this embodiment, since the switch unit 341 is turned on, the voltage of the node N1 may be boosted from a voltage Vnode to the voltage Vrst_H. Since the switch unit 361 is turned on, a voltage of the node Na is changed from a specific (unknown) voltage (shown by dotted lines) to the voltage VGL. Since the switch unit 363 is turned on, a voltage of the node Nb is changed from a specific (unknown) voltage (shown by dotted lines) to the ground voltage VGND. Since the switch unit 391 is turned on, the voltage of the node N2 is changed from the low-voltage-level voltage VL to the high-voltage-level voltage VH, so that the switch units 314 and 331 to 334 are turned off. In this embodiment, since all of the light-emitting units 321 to 324 emit light normally, the voltage of the node N1 may be restored to the voltage Vnode from time t2 to time t3.

During a sampling period P2 from time t3 to time t4, the sampling signal Sm is switched from a high voltage level to a low voltage level, so that the switch units 342 and 352 are switched to be turned on. In this embodiment, the switch unit 342 is turned on, so that the voltage Vnode of the node N1 may be the voltage Vrst_L plus 3 times a voltage Vlight (a cross voltage of a single light-emitting unit) (e.g., Vnode=Vrst_L+3×Vlight). In this embodiment, since the switch unit 352 is turned on, the node Na is changed from the voltage VGL to the voltage Vnode, and the voltage Vnode is greater than the voltage VGL. Further, a voltage Va of the node Nb may be the ground voltage VGND plus the voltage Vnode and minus the voltage VGL (e.g., Va=VGND+Vnode−VGL). Note that the voltage Va is slightly greater than the ground voltage VGND. In this embodiment, since the capacitor 362 may store the voltage of the previous node Na, the voltages of the nodes Na and Nb at two ends of the capacitor 362 may be maintained from time t4 to time t5.

During an enabling period P3 from time t5 to time t6, the enabling signal Em is switched from a high voltage level to a low voltage level, so that the switch units 312 and 381 are turned on. In this embodiment, since the switch unit 312 is turned on, the switch unit 312 may output the first current I1 provided from the current source 311 to the switch units 321 to 324 to drive the light-emitting units 321 to 324 to emit light. Further, the buffer 371 may be an inverter. When the switch unit 381 is turned on, the buffer 371 may transform the voltage Va of the node Nb to the voltage VH to be outputted to the node Nc. The voltage Va is at a low voltage level, and the voltage VH is at a high voltage level. Herein, since the node Nc has the voltage VH with a high voltage level same as the node N2, the switch units 314 and 331 to 334 are still maintained to be turned off. In other words, since the light-emitting units 321 to 324 may normally emit light, the bypass unit does not function. Therefore, in the light-emitting module 300 provided by the present embodiment, since all of the light-emitting units 321 to 324 emit light normally (not damaged or fail), a normal light-emitting function is provided.

Figure 5:
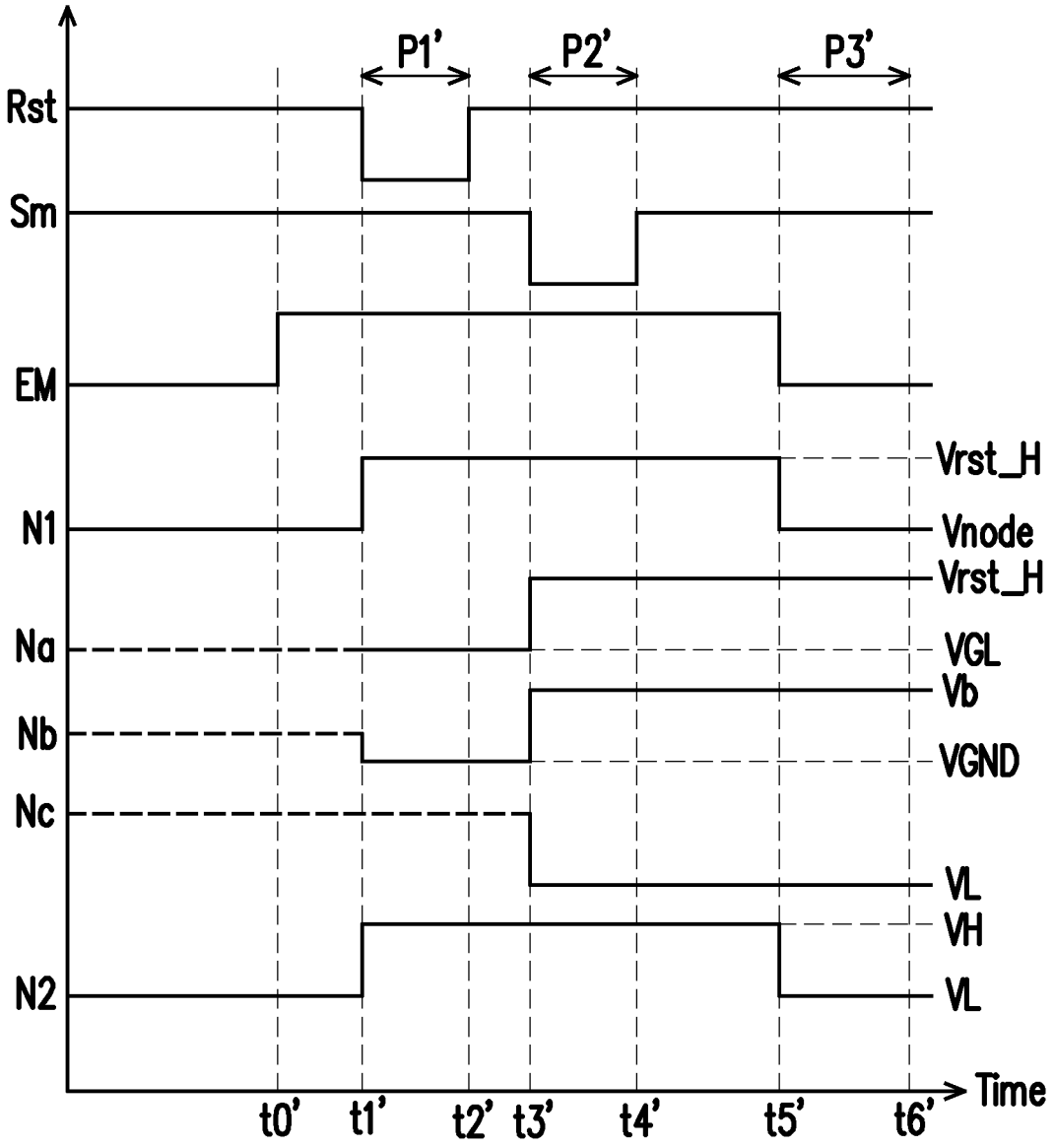
FIG. 5 is a sequence diagram of signal and voltage variations of the light-emitting module according to a second embodiment of the disclosure.

FIG. 5 is a sequence diagram of signal and voltage variations of the light-emitting module according to a second embodiment of the disclosure. With reference to FIG. 3 and FIG. 5, when part of the light-emitting units 321 to 324 of the light-emitting module 300 in FIG. 3 is damaged or fails, the signal and voltage variations of the light-emitting module 300 of FIG. 3 may be shown as the time sequence diagram provided by FIG. 5. In this embodiment, before time t0, the reset signal Rst and the sampling signal Sm are at high voltage levels, and the enabling signal Em is at a low voltage level. The switch unit 312 is turned on, and the current source 311 provides the first current I1 to the light-emitting units 321 to 324 through the node N1. From time t0' to time t1', the reset signal Rst and the sampling signal Sm maintain high voltage levels, and the enabling signal Em is switched from a low voltage level to a high voltage level, so that the switch units 312, 341, 342, 352, 361, 363, 381, and 391 are turned off. During a reset period P1' from time t1 to time t2, the reset signal Rst is switched from a high voltage level to a low voltage level, so that the switch units 341, 361, 363, and 391 are switched to be turned on. In this embodiment, since the switch unit 341 is turned on, the voltage of the node N1 may be boosted from the voltage Vnode to the voltage Vrst_H. Since the switch unit 361 is turned on, the voltage of the node Na is changed from a specific (unknown) voltage (shown by dotted lines) to the voltage VGL. Since the switch unit 363 is turned on, the voltage of the node Nb is changed from a specific (unknown) voltage (shown by dotted lines) to the ground voltage VGND. Since the switch unit 391 is turned on, the voltage of the node N2 is changed from the low-voltage-level voltage VL to the high-voltage-level voltage VH, so that the switch units 314 and 331 to 334 are turned off. In this embodiment, since part of the light-emitting units 321 to 324 is damaged or fails and thus is open, the voltage of the node N1 is maintained to be the voltage Vrst_H from time t2' to time t3'.

During a sampling period P2' from time t3' to time t4', the sampling signal Sm is switched from a high voltage level to a low voltage level, so that the switch units 342 and 352 are switched to be turned on. In this embodiment, although the switch unit 342 is turned on, part of the light-emitting units 321 to 324 is damaged or fails and is thus open, so that the voltage Vnode of the node N1 may be kept to be the voltage Vrst_H. In this embodiment, since the switch unit 352 is turned on, the node Na is changed from the voltage VGL to the voltage Vrst_H, and the voltage Vrst_H is greater than the voltage VGL. Further, a voltage Vb of the node Nb may be the ground voltage VGND plus the voltage Vrst_H and minus the voltage VGL (e.g., Vb=VGND+Vrst_H−VGL). Note that the voltage Vb is slightly greater than the ground voltage VGND. In this embodiment, since the capacitor 362 may store the voltage of the previous node Na, the voltages of the nodes Na and Nb at two ends of the capacitor 362 may be maintained from time t4' to time t5'.

During an enabling period P3' from time t5' to time t6', the enabling signal Em is switched from a high voltage level to a low voltage level, so that the switch units 312 and 381 are turned on. In this embodiment, since the switch units 312 and 381 are turned on, the switch unit 312 may output the first current I1 provided by the current source 312 to the light-emitting unit group 320, and the switch unit 381 may output the second current I2 provided by the current source 313 to the light-emitting unit group 320 at the same time. Further, the buffer 371 may be an inverter. When the switch unit 381 is turned on, the buffer 371 may transform the voltage Vb of the node Nb to the voltage VL to be outputted to the node Nc. The voltage Va is at a high voltage level, and the voltage VL is at a low voltage level. Herein, since the switch unit 381 is turned on, the voltage of the node N2 is switched from the voltage VH to the voltage VL, so that the switch units 314 and 331 to 334 are switched to be turned off.

In this embodiment, the switch units 331 to 334 are P-type transistors and may be designed through, for example, a process layout. In this way, an equivalent resistance of each of the turned-on switch units 331 to 334 is greater than that of a normal light-emitting unit and is lower than that of a damaged or failing light-emitting unit. For instance, when the light-emitting unit 322 is damaged and the light-emitting units 321, 323, and 324 may normally emit light, since the equivalent resistances of the light-emitting units 321, 323, and 324 are respectively lower than the equivalent resistances of the switch units 331, 333, and 334, and the equivalent resistance of the light-emitting unit 322 is to be greater than that of the corresponding switch unit 332, a current from the node N1 is to pass through the light-emitting unit 321, the switch unit 332, the light-emitting unit 323, and the light-emitting unit 324 in sequence. In other words, when the damaged light-emitting unit 322 is open, the switch unit 332 may be turned on to bypass the open light-emitting unit 322. The switch unit 332 may replace the damaged light-emitting unit 322 to provide a current bypass path, so that the light-emitting units 321, 323, and 324 may still be driven, and that the light-emitting function of the light-emitting unit group 320 providing the normal light-emitting function is maintained. Further, since the switch unit 314 is turned on, the node N1 receives the first current I1 and the second current I2 together to be provided to the light-emitting unit group 320. Herein, since the number of the light-emitting units in the light-emitting unit group 320 capable of emitting light normally decreases, in order to allow overall brightness to be maintained, a current configured to drive the light-emitting unit group 320 is increased through the current source 313 in the light-emitting module 300, so that light-emitting brightness of the rest of the light-emitting units in the light-emitting unit group 320 capable of emitting light normally is increased.

Further, note that the disclosure is not limited to the case that only one light-emitting unit 322 is damaged or fails. In some embodiments of the disclosure, when one, two, or three of the light-emitting units 321 to 324 are damaged or fail, the light-emitting module 300 provided by the disclosure may set the rest of the light-emitting unit(s) to emit light continuously. In some other embodiments provided by the disclosure, the light-emitting units of the light-emitting unit group 320 require only one light-emitting unit capable of emitting light normally, and the light-emitting module 300 provided by the disclosure may set the remaining light-emitting unit to emit light continuously.

In this embodiment, each of the light-emitting units 321 to 324 is required to be driven by, for example, a predetermined current i, such that the first current I1 may be equal to, for example, 4 times a current Ia (i.e., I1=4×i). Further, the second current I2 may be designed to be, for example, 1/a times the first current I1 (i.e., I2=(1/a)×I1), and the parameter "a" is a positive integer greater than 1. The parameter "a" may be a predetermined value and is not particularly limited by the disclosure. Besides, in other embodiments of the disclosure, in the light-emitting module 300, the light-emitting unit group including a damaged or failing light-emitting unit may also be compensated through other manners. For instance, in the light-emitting module 300, each of the light-emitting units of each light-emitting unit group may be detected, such as that the corresponding second current I2 (i.e., different values of parameter "a" are designed) may be individually provided according to the damaged or failing light-emitting unit. Alternatively, in the light-emitting module 300, a light-emitting result of the light-emitting unit group with a damaged or failing light-emitting unit may be determined through analysis of an image of the light-emitting result, and magnitude of the second current I2 may be dynamically adjusted (i.e., different values of a are designed).

Figure 6:
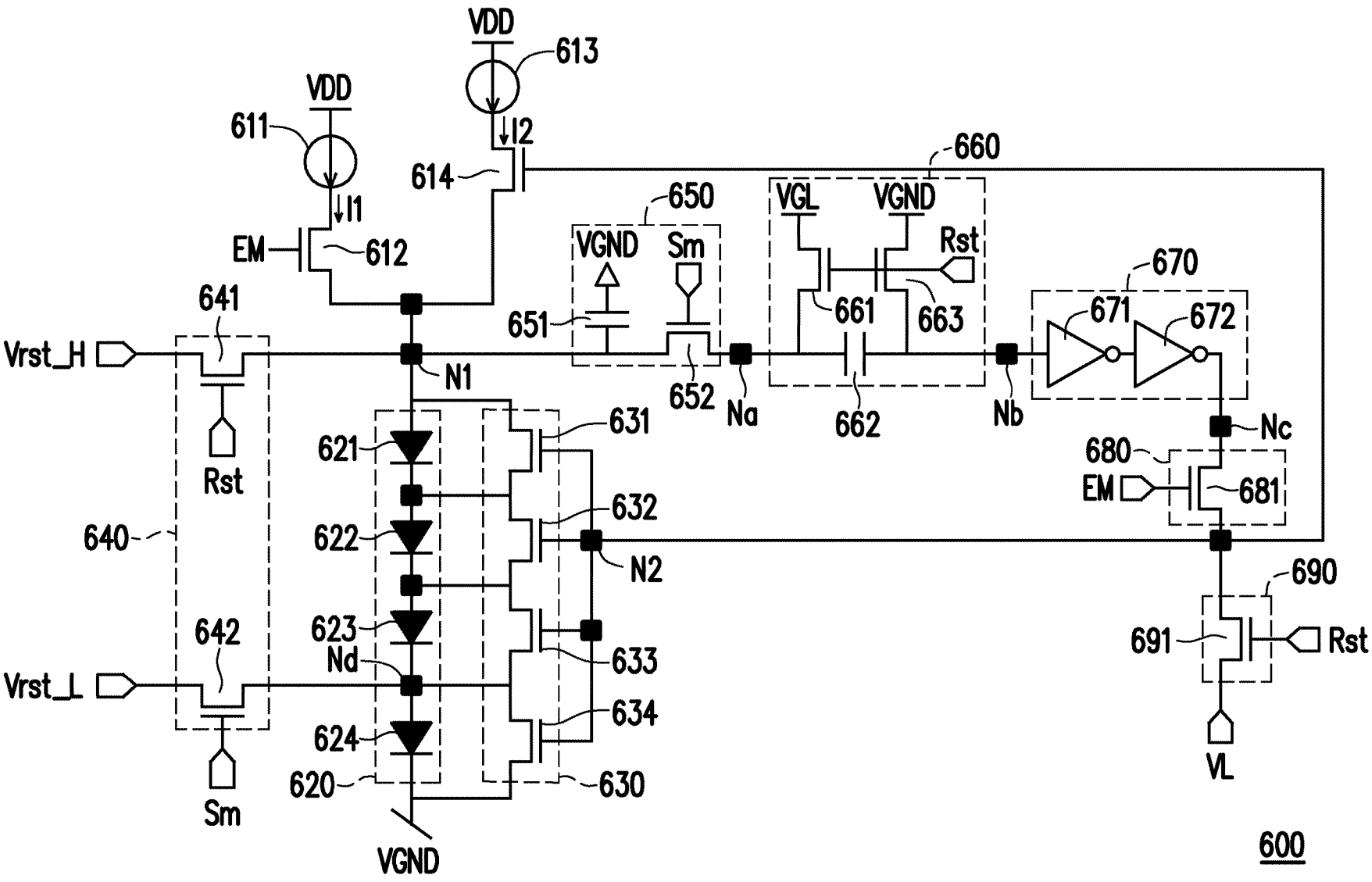
FIG. 6 is a schematic diagram of circuits of a light-emitting module according to another embodiment of the disclosure.

FIG. 6 is a schematic diagram of circuits of a light-emitting module according to another embodiment of the disclosure. With reference to FIG. 6, in this embodiment, a switch unit is implemented as a N-type transistor to act as an example of a circuit implementation manner. In this embodiment, a light-emitting module 600 includes current sources 611 and 613, switch units 612 and 614, a light-emitting unit group 620, a bypass unit 630, reset units 640 and 690, a sampling unit 650, a boosting unit 660, a buffering unit 670, and an enabling unit 680. In this embodiment, the switch units 612 and 614 may be N-type transistors. In this embodiment, the current source 611 is coupled between the voltage VDD and a first terminal of the switch unit 612 and is configured to provide the first current I1 to the first terminal of the switch unit 612. A second terminal of the switch unit 612 is coupled to the node N1. A control terminal of the switch unit 612 receives the enabling signal EM and determines whether to be turned on according to the enabling signal EM, so that the second terminal of the switch unit 612 provides the first current I1 to the node N1. In this embodiment, the current source 613 is coupled between the voltage VDD and a first terminal of the switch unit 614 and is configured to provide the second current I2 to the first terminal of the switch unit 614. The light-emitting unit group 620 is coupled between the node N1 and the ground voltage VGND. The light-emitting unit group 620 includes a plurality of light-emitting units 621 to 624 coupled to each other in series. The bypass unit 630 is coupled to the light-emitting unit group 620 in parallel. The bypass unit 630 includes a plurality of switch units 631 to 634, and the switch units 631 to 634 may be N-type transistors. The switch units 631 and 634 are coupled to the light-emitting units 621 to 624 in parallel one to one, so as to respectively provide corresponding current bypass paths to the light-emitting units 621 to 624.

In this embodiment, the sampling unit 650 is coupled to the light-emitting unit group 620 through the node N1 and is configured to sample the voltage of the node N1. The sampling unit 650 includes a capacitor 651 and a switch unit 652. One terminal of the capacitor 651 is coupled to the ground voltage VGND, and another terminal is coupled to the node N1 to store a sampled voltage sampled from the node N1. The switch unit 652 may be a N-type transistor. A first terminal of the switch unit 652 is coupled to the node N1, and a second terminal of the switch unit 652 is coupled to the node Na. A control terminal of the switch unit 652 is coupled to the sampling signal Sm to determine whether to provide the sampled voltage stored by the capacitor 651 to the node Na according to the sampling signal Sm.

In this embodiment, the boosting unit 660 is coupled to the sampling unit 650. The boosting unit 660 includes switch units 661 and 663 and a capacitor 662. The switch units 661 and 663 may be N-type transistors. A first terminal of the switch unit 661 is coupled to the voltage VGL (reference voltage), and a second terminal of the switch unit 661 is coupled to the node Na. A control terminal of the switch unit 661 is coupled to the reset signal Rst. One terminal of the capacitor 662 is coupled to the second terminal of the switch unit 661 and the node Na. A first terminal of the switch unit 663 is coupled to the ground voltage VGND, and a second terminal of the switch unit 663 is coupled to another terminal of the capacitor 662 and the node Nb. A control terminal of the switch unit 663 is coupled to the reset signal Rst. In this embodiment, the buffering unit 670 is coupled to the boosting unit 660 and the enabling unit 680. The buffering unit 670 includes buffers 671 and 672. An input terminal of the buffer 671 is coupled to the node Nb, and an output terminal of the buffer 671 is coupled to the enabling unit 680 through the node Nc. In this embodiment, the enabling unit 680 is coupled to the bypass unit 630 through the node N2. The enabling unit 680 includes a switch unit 681. The switch unit 681 may be a N-type transistor. A first terminal of the switch unit 681 is coupled to the node Nc, and a second terminal of the switch unit 681 is coupled to a control terminal of each one of the switch units 631 to 634 and the switch unit 614 through the node N2. A control terminal of the switch unit 681 receives the enabling signal EM to determine whether to turn on the switch units 631 to 634 and the switch unit 614 according to a voltage sampling result of the sampling unit 650 sampling the node N1 according to the enabling signal EM.

In this embodiment, the reset unit 640 is coupled to the node N1. The reset unit 640 includes switch units 641 and 642. The switch units 641 and 642 may be N-type transistors. A first terminal of the switch unit 641 is coupled to a voltage Vrst_H (high voltage level), and a second terminal of the switch unit 641 is coupled to the node N1. A control terminal of the switch unit 641 receives the reset signal Rst. A first terminal of the switch unit 642 is coupled to the voltage Vrst_L (low voltage level), and a second terminal of the switch unit 642 is coupled to the node Nd between the light-emitting unit 623 and the light-emitting unit 624. A control terminal of the switch unit 642 receives the sampling signal Sm. In this embodiment, the reset unit 690 is coupled to the node N2. The reset unit 690 includes a switch unit 691. The switch unit 691 may be a N-type transistor. A first terminal of the switch unit 691 is coupled to the control terminal of the switch unit 614, the second terminal of the switch unit 681, and the node N2. A second terminal of the switch unit 691 is coupled to the voltage VL (low voltage level). A control terminal of the switch unit 691 is coupled to the reset signal Rst.

Herein, in the light-emitting module 600, when all of the light-emitting units 621 to 624 normally emit light (not damaged or fail), or part of the light-emitting units 621 to 624 is damaged or fails, the signal and voltage variations of the light-emitting module 600 may be deduced from the sequence diagrams and description provided by the embodiments of FIG. 4 and FIG. 5, and repeated description is thus not provided.

In view of the foregoing, according to some embodiments, the display device provided by the disclosure includes the light-emitting unit group and the bypass unit. The bypass unit is coupled to the light-emitting unit group in parallel, and the bypass unit includes the plurality of first switch units. According to some embodiments, when at least one light-emitting unit in the light-emitting unit group is damaged or fails, causing the serial path of the light-emitting units to be open, a bypass may be formed owing to arrangement of the bypass unit to set the light-emitting units to be electrically connected, such that the light-emitting unit group may continue to emit light. Further, according to some embodiments, when at least one light-emitting unit in the light-emitting unit group of a specific light-emitting region is damaged or fails, in the display provided by the disclosure, the driving current of the light-emitting unit group may be increased through another current source, such that the light-emitting unit group may maintain an identical or a similar light-emitting brightness result. Therefore, a favorable light-emitting function or display effect is provided by the display of the disclosure.

Finally, it is worth noting that the foregoing embodiments are merely described to illustrate the technical means of the disclosure and should not be construed as limitations of the disclosure. Even though the foregoing embodiments are referenced to provide detailed description of the disclosure, people having ordinary skill in the art should understand that various modifications and variations can be made to the technical means in the disclosed embodiments, or equivalent replacements may be made for part or all of the technical features; nevertheless, it is intended that the modifications, variations, and replacements shall not make the nature of the technical means to depart from the scope of the technical means of the embodiments of the disclosure. Further, as long as the features of the embodiments do not violate or do not conflict with the spirit of the disclosure, they may be mixed and matched arbitrarily.

What is claimed is:

1. A display device, comprising a plurality of light-emitting modules, wherein at least one of the plurality of light-emitting modules comprises:

a light-emitting unit group, comprising a plurality of light-emitting units coupled to each other in series;

a first current source, coupled to the light-emitting unit group, configured to provide a first current to drive the plurality of light-emitting units;

a bypass unit, comprising a plurality of first switch units, coupled to the light-emitting unit group in parallel, wherein the plurality of first switch units are coupled to the plurality of light-emitting units in parallel;

a second switch unit, coupled to the light-emitting unit group and the bypass unit; and a second current source, coupled to the second switch unit, configured to provide a second current.

2. The display device according to claim 1, wherein an equivalent resistance of at least one of the plurality of first switch units is greater than an equivalent resistance of a normal light-emitting unit.

3. The display device according to claim 1, wherein the second current is less than the first current.

4. The display device according to claim 1, further comprising:

a sampling unit, coupled to the light-emitting unit group through a first node, configured to sample a first voltage of the first node; and an enabling unit, coupled to the sampling unit, coupled to the bypass unit and the second switch unit through a second node, wherein the enabling unit is configured to determine whether to turn on the first switch unit and the second switch unit according to the first voltage.

5. The display device according to claim 4, wherein the enabling unit is configured to turn on the plurality of first switch units when at least one of the plurality of light-emitting units is open.

6. The display device according to claim 4, wherein the enabling unit is configured to turn on the second switch unit when at least one of the light-emitting units is open, wherein the light-emitting unit group receives the first current and the second current.

7. The display device according to claim 4, further comprising:

a boosting unit, coupled to the sampling unit, configured to convert the first voltage into a second voltage; and a buffering unit, coupled to the boosting unit and the enabling unit, configured to provide a third voltage to the enabling unit according to the second voltage, wherein the enabling unit provides the third voltage to the plurality of first switch units and the second switch unit, and the plurality of first switch units and the second switch unit determine whether to be turned on according to the third voltage.

8. The display device according to claim 1, further comprising:

a first reset unit, coupled to the first node and configured to reset a voltage of the first node according to a reset signal.

9. The display device according to claim 8, wherein the first reset unit comprises a seventh switch unit, wherein the a first terminal of the seventh switch unit is coupled to a voltage having a high voltage level, a second terminal of the seventh switch unit is coupled to the first node, and a control terminal of the seventh switch unit receives the reset signal.

10. The display device according to claim 1, further comprising:

a second reset unit, coupled to the bypass unit through a second node and configured to reset a voltage of the second node according to a reset signal.

* * * * *